US009822643B2

(12) United States Patent
Batt et al.

(10) Patent No.: US 9,822,643 B2
(45) Date of Patent: Nov. 21, 2017

(54) COOLED VANE OF A TURBINE AND CORRESPONDING TURBINE

(75) Inventors: Stephen Batt, Lincoln (GB); Andy Pacey, Lincoln (GB)

(73) Assignee: SIEMENS AKTIENGESELLSCHAFT, München (DE)

( * ) Notice: Subject to any disclaimer, the term of this patent is extended or adjusted under 35 U.S.C. 154(b) by 872 days.

(21) Appl. No.: 13/701,911

(22) PCT Filed: Apr. 29, 2011

(86) PCT No.: PCT/EP2011/056815

§ 371 (c)(1),
(2), (4) Date: Mar. 15, 2013

(87) PCT Pub. No.: WO2011/154195

PCT Pub. Date: Dec. 15, 2011

(65) Prior Publication Data

US 2013/0209230 A1 Aug. 15, 2013

(30) Foreign Application Priority Data

Jun. 7, 2010 (EP) ..... 10165110

(51) Int. Cl.

| | |
|---|---|
| ***F01D 9/06*** | (2006.01) |
| ***F01D 5/04*** | (2006.01) |
| ***F01D 5/18*** | (2006.01) |
| ***F01D 9/04*** | (2006.01) |

(52) U.S. Cl.

CPC ..... *F01D 5/041* (2013.01); *F01D 5/181* (2013.01); *F01D 9/042* (2013.01); *F05D 2300/603* (2013.01)

(58) Field of Classification Search

CPC ..... F01D 5/181; F01D 9/041; F01D 9/042; F05D 2300/603

USPC ..... 415/115

See application file for complete search history.

(56) References Cited

U.S. PATENT DOCUMENTS 2,578,481 A 12/1951 Lombard
2,974,926 A * 3/1961 Thompson, Jr. ..... F01D 5/187 416/92
3,094,310 A 6/1963 Bowmer
3,220,697 A 11/1965 Davidson
(Continued)

FOREIGN PATENT DOCUMENTS

CN 101021166 A 8/2007
EP 0892149 A1 1/1999
(Continued)

OTHER PUBLICATIONS

G. A. Halls "Air Cooling of Turbine Blades" Flight International Jul. 13, 1967. p. 76; 1967; Jul. 13, 1967.

*Primary Examiner* — Mark Laurenzi
*Assistant Examiner* — Anthony Ayala Delgado

(57) ABSTRACT

A vane is provided for use in a fluid flow of a turbine engine. The vane includes a thin-walled radially extending aerodynamic vane body having axially spaced leading and trailing edges, and a radially outer platform. The wall of the vane body includes an outer shell and an inner shell and defines an interior cavity therein for flowing a cooling medium. A radially extending load strut is arranged at the inner shell of the wall of the leading edge of the vane body.

15 Claims, 2 Drawing Sheets

(56) References Cited

U.S. PATENT DOCUMENTS

| | | | | |
|---|---|---|---|---|
| 4,005,572 | A | 2/1977 | Giffhorn | |
| 5,100,293 | A * | 3/1992 | Anzai | F01D 5/186 416/96 A |
| 5,215,431 | A | 6/1993 | Derrien | |
| 5,342,172 | A * | 8/1994 | Coudray et al. | 416/97 R |
| 5,419,039 | A | 5/1995 | Przirembel | |
| 5,484,258 | A * | 1/1996 | Isburgh | F01D 5/187 415/115 |
| 5,660,524 | A | 8/1997 | Isburgh | |
| 6,318,963 | B1 * | 11/2001 | Emery | F01D 5/186 416/96 A |
| 8,807,943 | B1 * | 8/2014 | Liang | 416/97 R |
| 2007/0140835 | A1 | 6/2007 | Albrecht | |
| 2009/0047136 | A1 | 2/2009 | Bridges, Jr. | |

FOREIGN PATENT DOCUMENTS

| | | | |
|---|---|---|---|
| EP | 1895109 | A2 | 3/2008 |
| RU | 2399771 | C2 | 9/2010 |
| RU | 2489573 | C2 | 8/2013 |

* cited by examiner

COOLED VANE OF A TURBINE AND CORRESPONDING TURBINE

CROSS REFERENCE TO RELATED APPLICATIONS

This application is the US National Stage of International Application No. PCT/EP2011/056815, filed Apr. 29, 2011 and claims the benefit thereof. The International Application claims the benefits of European application No. 10165110.7 EP filed Jun. 7, 2010. All of the applications are incorporated by reference herein in their entirety.

FIELD OF INVENTION

The invention relates to a vane for use in a fluid flow of a turbine engine and further to a turbine engine.

BACKGROUND OF INVENTION

Gas turbines have a compressor assembly, a combustor assembly and a turbine assembly. The compressor compresses normally ambient air, which is then channeled into the combustor, where it is mixed with a fuel. The fuel and compressed air mixture is ignited, creating a working gas that may reach high temperatures, up to 1300° C. to 1600° C., for example. This working gas then passes through the turbine assembly. In some gas turbines CO2 is the main component of the working medium. In that case pure oxygen is added as is fuel in the combustion chamber to burn and heat up the CO2 gas. The turbine assembly has a rotating shaft holding a plurality of rows of rotating wheels. The turbine assembly can have a plurality of stationary wheels attached to a casing of the turbine. Each rotating wheel is preceded by a stationary wheel to direct the working gas at an optimum angle against the vanes of the rotating wheels. Expansion of the working gas through the turbine assembly results in a transfer of energy from the working gas to the rotating wheels, causing rotation of the shaft.

Each vane of a wheel may have an outer platform connected to a radially outer end of the vane body for attachment to the turbine casing, and an inner platform connected to the inner end of the vane body. The outer platforms for a given row of vanes are mounted adjacent to each other as segments in a circular array, defining an outer shroud ring. The inner platforms are likewise mounted adjacent to each other in a circular array, defining an inner shroud ring. These outer and inner shroud rings define a flow channel between them to channel the working gas.

The vane body may include passages for a cooling fluid, such as air. However, the surfaces of the vane assemblies exposed to the working gas are subjected to high operational temperatures and thermal stresses. This can cause cracks in the vane body and platforms. Typically, each vane body and at least one platform are formed together as a unitary structure, so damage to a platform may require replacement of an entire vane assembly, even when the vane body is still in a serviceable condition.

Each vane of a turbine engine, like a gas or steam turbine engine, has areas of excessive stress in the aerofoil leading edge area due to a mechanical loading of the vane in the downstream direction. Such vanes have an internal cooling and therefore and because of thermal stress reasons the vane body of the vanes has a limit on the maximum wall thickness.

The aerodynamic design of the vane body has been changed in the past to give a larger volume of material at the leading edge whilst maintaining the maximum wall thickness. Therefore the aerodynamic performance is degraded in order to reduce the stress levels to an acceptance limit.

To improve the strength of the vane body several constructive features are known. The U.S. Pat. No. 5,484,258 discloses a guide vane with a double outer wall. The outer wall of the vane body has a one-pieced integrally formed double wall construction including an inner wall spaced apart from an outer wall with mechanically and thermally tying elements in the form of continuous tying ribs which are integrally formed with and disposed between the inner and outer walls. The ribs space apart the inner and outer walls and respectively such that the walls are essentially parallel to each other. Such a double outer wall is structurally very complicated and expensive to manufacture.

A web-like structure in the inside of a vane body is known from U.S. Pat. No. 5,660,524. The vane body has a first outer wall and a second outer wall together defining an airfoil shape including a leading edge, a trailing edge, a pressure side along the first outer wall, a suction side along the second outer wall, a blade tip and a blade root. Between the two outer walls are a couple of monolithic inner walls arranged. These monolithic inner walls have a web-like structure to strengthen the vane body or the outer walls of the vane body, respectively. The web-like inner structure makes the cooling of the vane body complicated and expensive. Further, the web-like inner structure increases the weight of the vane and therefore decreases the aerodynamic performance of the vane.

A similar web-like structure is known from U.S. Pat. No. 2,974,926. The turbine blade comprises an outer shell and a center strut-root-fin assembly. The center strut-root-fin assembly comprises a root, which is preferably of a conventional fir tree type. The root extends downwardly from a root platform and is embedded in the core of a turbine motor. The center strut-root-fin assembly further comprises a strut to which fins are attached. The strut is secured to the root platform. The strut extends from the root platform upwardly. In the assembled position of the turbine blade the outer shell of the turbine blade is slipped over the strut-root-fin assembly. The outer shell is spot welded at various places along the blade height to the fins of the strut-root-fin assembly and at various places around a shell platform to a root platform ledge. The spot welds between the fins of the strut-root-fin assembly and the outer shell are arranged at the suction side and at the pressure side of the turbine blade. To enable to slip the outer shell over the strut-root-fin assembly there are tolerances between the outer shell and the strut-root-fin assembly. Welding the fins to the suction side and the pressure side of the outer shell is complicated and cost effective.

US 2009/0047136 A1 discloses a stator with an airfoil, an outer diameter shroud and an inner diameter shroud. The airfoil comprises a thin-walled structure that forms a hollow cavity leading edge, pressure side, suction side and trailing edge. The airfoil further comprises interior cooling features including cooling channels, cooling holes, gill holes, peanut cavities, an impingement rib, nozzles, a divider, partitions, trip strips, an outer diameter end cap and an inner diameter end cap. Cooling air enters the cooling holes at the leading edge of the airfoil to flow into the peanut cavity between the leading edge and the impingement rib or into to cooling channels behind the impingement rib. The impingement rib is spaced apart from the leading edge and runs partially parallel to the leading edge of the airfoil.

SUMMARY OF INVENTION

Therefore it is an object of the invention to provide a vane for use in a fluid flow of a turbine engine which enables to reduce the stresses induced into the vane to an acceptable level without adverse effects on the cooling of the vane body and the aerodynamic performance of the vane. Further, a turbine engine should be provided, which can be manufactured easy and cost-effective and which can resist high stresses, like thermal stresses.

The problem of the invention is solved by the features of the independent claim(s). Advantages, features, details, aspects and effects of the invention arise from the dependent claims, the description and the figures. Features and details which are described in connection with the vane count as well for the turbine engine, and vice versa.

According to a first aspect of the present invention the problem is solved by a vane for use in a fluid flow of a turbine engine comprising a thin-walled radially extending aerodynamic vane body having axially spaced leading and trailing edges, the wall of said vane body comprising an outer shell and an inner shell, the wall of said vane body defining an interior cavity therein for flowing a cooling medium, and an radially outer platform, whereby a radially extending load strut is arranged at the inner shell of the wall of the leading edge of the vane body. The outer shell corresponds to the outer surface of the vane wall and the inner shell corresponds to the inner surface of the vane wall. Preferred is the vane a guide vane of a guide wheel of a turbine engine. Further, the vane can be also a vane of a rotating wheel of a turbine engine. The vane of a rotating wheel is also known as blade. The load strut is added to the inside of the vane leading edge. Therefore the leading edge is stiffened and the bending load can reacted onto a wider portion of the outer platform of the vane. The load strut reduces the stresses, in particular the thermal stresses, induced into the vane to an acceptable level without adverse effect on the cooling of the aerofoil and the aerodynamic performance of the vane. The interior cavity of the vane body is not or only marginal effected by the load strut, because the load strut extends parallel to the leading edge of the vane. The load strut protrudes advantageously only a little bit into the interior cavity of the vane body, so that the flow of the cooling medium, especially the flow of a fluid medium, through the interior cavity of the body vane is not effected in a negative way. Advantageously the load strut has a rectangular cross-section form. The load strut itself has an elongated form. The load strut protrudes at the inner shell of the wall of the leading edge of the vane body. The load strut increases in contrast to the double wall or the web-like structure according to the aforementioned prior art the weight of the vane only marginal.

According to a preferred development of the vane, the outer platform of the vane covers the end of the vane body, whereby the load strut is arranged at the outer platform. The outer platform is extended to cover the end of the load strut. Therefore the leading edge can be better stiffened and the bending load is reacted onto a wider portion of the outer platform. The load strut expands the leading edge of the vane body and therefore increases the contact to the covering outer platform. The combination of the leading edge and the load strut has an umbrella-like cross-section form. This allows that the bending load is reacted to a greater surface of the covering outer platform of the vane.

According to a preferred development of the invention, a vane can be provide, whereby the wall of the vane body and the load strut are integrally formed and are produced in one operation in a common mold. That means the load strut and the leading edge and the vane body, respectively, are advantageously made out of one-piece. Preferred is a vane whereby the load strut and the vane body are monolithic manufactured. The outer platform which covers the tip of the vane can be welded to the front end of the leading edge and the load strut.

Alternatively a vane is preferred, whereby the wall of the vane body, the outer platform and the load strut are integrally formed and are produced in one operation in a common mold. Such a structure stiffens the transition region between the front end of the vane body at the leading edge and the load strut to the outer platform. A monolithic manufacture of the wall of the vane body, the load strut and the outer platform enables that stresses induced into the vane at the leading edge can be reduced to an acceptable level.

According to a preferred development of the invention the load strut of the vane is arranged at the inner shell of the wall of the entire leading edge of the vane body. The load strut extends radially between the vane tip and a vane root. The load strut can extend over the full length of the vane body that means between the inner and outer platform. Alternatively, the load strut can extend only along a part of the length of the load strut. The load strut can extend from the middle of the vane body to the outer platform, for example.

In another even more preferred embodiment of vane, the vane is characterized in that the end of the load strut which is averted to the outer platform is arranged at a protrusion at the inner shell of the wall. That means the load strut is added to the inside of that part of the vane leading edge which is arranged next to the outer platform. Therefore, according to a very preferred development of the invention the protrusion is arranged at the inner shell of the wall in the central area of the vane body. Such an arrangement of the load strut stiffens the vane leading edge at the vane tip. The protrusion at the inner shell of the wall can be shaped in different ways. The protrusion can be built by a weld seam. Advantageously the protrusion is like a salient bolt or the like.

According to another preferred development of the invention the protrusion at the inner shell of the wall of the vane body has a U-shaped, a ring-shaped or ringlike form. The U-shaped, ring-shaped or ringlike protrusion is advantageously manufactured in one-piece with the wall of the vane body. The U-shaped, ring-shaped or ringlike protrusion is preferred arranged at the inside of the wall from the suction side, over the leading edge to the pressure side of the vane. Thereby the leading edge of the vane can be stiffened and the stresses in that part of the leading edge can be forwarded into the body of the vane. Such a protrusion makes the entire vane body more rigid without effecting the cooling of the vane negatively and without effecting to the aerodynamic performance of the vane negatively.

The ring-shaped or ringlike protrusion can be closed like a complete ring. Such a protrusion is arranged along the entire wall and the inner shell of the wall, respectively. Preferred is a protrusion with a U-shaped form.

As mentioned before, a vane is preferred, whereby the protrusion and the wall of the vane body are integrally formed and are fabricated in one operation in a common mold. Alternatively, the load strut can be welded to the protrusion, to the wall of the vane body and to the outer platform.

According to a further preferred embodiment of the vane, the vane can comprise an inner platform at the root end of the vane. The inner platform and the wall of the vane body are advantageously integrally formed and are fabricated in one operation in a common mold.

The vane can consist of metal, ceramics or fiber composite.

Preferred is the vane a guide vane of a guide wheel of a turbine engine. The vane will be preferably non-rotating.

Further, the vane can possibly be also a vane of a rotating wheel of a turbine engine, i.e. a blade. The turbine engine is advantageously a gas turbine engine, possibly also a steam turbine engine.

According to a second aspect of the present invention the problem is solved by a turbine engine comprising at least one rotating wheel with a plurality of rotating vanes and at least one guide wheel with a plurality of guide vanes, whereby the rotating vanes and/or the guide vanes are built like the vane according to the first aspect of the invention. Such a turbine engine can be manufactured easy and cost-effective and can resist high stresses, in particular high thermal stresses, because of the stress-resistant vanes of the guide and/or rotating wheels. The turbine engine is advantageously a gas turbine engine or a steam turbine engine.

BRIEF DESCRIPTION OF THE DRAWINGS

The foregoing, and other features and advantages of the present invention, will become more apparent in the light of the following description and the accompanying drawings, where.

DETAILED DESCRIPTION OF INVENTION

Figure 1:
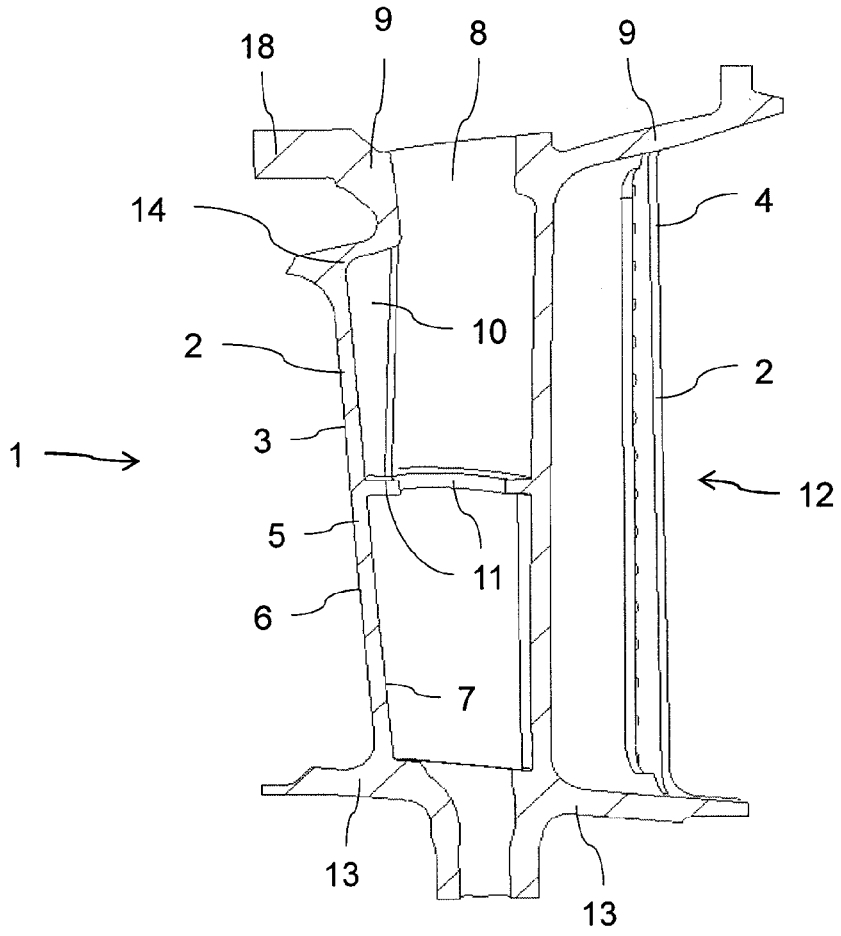
FIG. 1 shows schematic in a longitudinal-section a vane for use in a fluid flow of a turbine engine, which is being built according to the construction principle of the invention.
Figure 2:
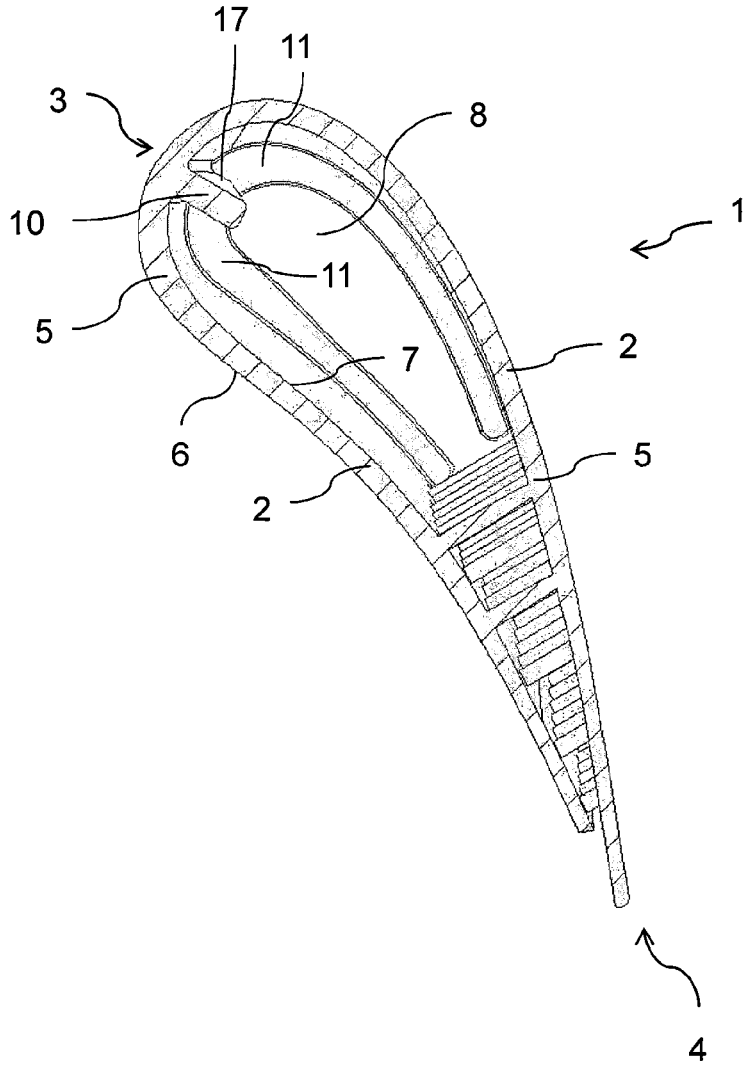
FIG. 2 shows schematic in a cross-section a vane for use in a fluid flow of a turbine engine, which is being built according to the construction principle of the invention.

Elements with the same function and mode of operation are provided in the FIGS. 1 to 2 with the same references.

FIG. 1 shows schematic in a longitudinal-section one possible embodiment of a vane 1 for use in a fluid flow of a turbine engine, which is being built according to the construction principle of the invention. The vane 1 comprises a thin-walled radially extending aerodynamic vane body 2 having axially spaced a leading edge 3 and a trailing edge 4. The vane body 2 has a wall 5 comprising an outer shell 6 and an inner shell 7. The wall 5 of said vane body 2 defining an interior cavity 8 therein for flowing a cooling medium. The vane 1 further comprises an outer platform 9 and an inner platform. A radially extending load strut 10 is arranged at the inner shell 7 of the wall 5 of the leading edge 3 of the vane body 2.

The load strut 10 is added to the inside of the vane leading edge 3. The load strut 10 stiffens the leading edge 3 and the bending load can be transferred onto a wider portion of the outer platform 9 of the vane 1. The load strut 10 reduces the stresses induced into the vane 1 to an acceptable level without adverse effects on the cooling of the vane body 2 and the aerodynamic performance of the vane. The interior of the vane body 2 is not or only marginal effected by the load strut 10, because the load strut 10 extends parallel to the leading edge 3 of the vane 1.

The load strut 10 protrudes only a little bit into the interior cavity 8 of the vane body 2, so that the flow of the cooling medium, especially the flow of a fluid medium, through the interior cavity 8 of the body vane 2 is not effected in a negative way. The load strut has a rectangular cross-section and a longish form. The load strut 10 protrudes at the inner shell 7 of the wall 5 of the leading edge 3 of the vane body 2.

The outer platform 9 of the vane covers the end of the vane body 2, whereby the load strut 10 is arranged at the outer platform 9. The outer platform 9 is extended in such a way that it covers the end of the load strut 10, as well. Therefore the leading edge 3 can be better stiffened and the bending load is reacted onto a wider portion of the outer platform 9.

The wall 5 of the vane body 2, the inner platform 13, the outer platform 9, the load strut 10 and the protrusion 11 are integrally formed and are fabricated in one operation in a common mold. The load strut 10 stiffens the transition region 14 between the wall 5 of the vane body 2 at the leading edge 3 and the load strut 10 to the outer platform 9. The load strut 10 expands the leading edge 3 of the vane body 2 and therefore increases the contact to the covering outer platform 9.

The load strut 10 is arranged from the central area 12 of the vane body 2 to outer platform 9. Therefore the protrusion 11 which holds the load strut 10 is arranged in the central area 12 of the vane body 2. The load strut 10 has the form of a part of a ring or better is U-shaped and is arranged at the inner shell 7 of the wall 5 of the vane body 2.

The combination of the leading edge 3 and the load strut 10 has an umbrella-like cross-section form, as illustrated in FIG. 2. The combination of the wall 5 of the leading edge 3 and the load strut 10 allows that the bending load of the vane 1, especially of the leading edge 3, is transferred to a greater surface of the covering outer platform 9 of the vane 1. The load strut 10 extends to the interior cavity 8 of the vane 1 without effecting the cooling of the vane 1 negatively. Such a vane 1 enables that the leading edge is stiffened and the bending load is reacted onto a wider portion of the outer platform 9. The stresses induced into the vane 1 are reduced to an acceptable level without adverse effect on the cooling of the vane body 2 or the airfoil, respectively, or the aerodynamic performance of the vane 1. The front rail 18 of the vane 1 is fixed to a mounting arrangement.

The invention claimed is:

1. A vane for use in a fluid flow of a turbine engine, comprising:

a thin-walled radially extending aerodynamic vane body having axially spaced leading and trailing edges, the wall of said vane body comprising an outer surface and an inner surface, the wall of said vane body defining an interior cavity therein for flowing a cooling medium, and a radially outer platform comprising a front rail, wherein the radially outer platform covers an end of the vane body, wherein a radially extending load strut is connected to the inner surface at the leading edge of the vane body, wherein the load stmt braces the vane body against the front rail of the radially outer platform, wherein the load strut tapers in the radially inward direction, wherein the wall of the vane body and the load stmt are integrally formed and are produced in one operation in a common mold.

2. The vane according to claim 1, wherein the load strut is arranged at the outer platform.

3. The vane according to claim 1, wherein the wall of the vane body, the outer platform and the load stmt are integrally formed and are produced in one operation in a common mold.

4. The vane according to claim 1, wherein the load strut is arranged at the inner surface of the wall of the entire leading edge of the vane body.

5. The vane according to claim 2, wherein a protrusion is arranged at the inner surface of the wall and in the central area of the vane body, wherein, the load stmt is averted from the protrusion to the outer platform.

6. The vane according to claim 5, wherein the protrusion has a U-shaped, ring-shaped or ringlike form.

7. The vane according to claim 5, wherein the protrusion and the wall of the vane body are integrally formed and are fabricated in one operation in a common mold.

8. The vane according to claim 5, wherein the load stmt is welded to the protrusion, to the wall of the vane body and to the outer platform.

9. The vane according to claim 1, wherein the vane further comprises an inner platform.

10. The vane according to claim 1, wherein the vane comprises metal, ceramic or fiber composite.

11. The vane according to claim 1, wherein the vane is a guide vane of a guide wheel of a turbine engine.

12. A turbine engine, comprising:

at least one rotating wheel with a plurality of rotating vanes, and at least one guide wheel with a plurality of guide vanes, wherein the plurality of rotating vanes and/or the guide vanes includes a vane according to claim 1.

13. The turbine engine according to claim 12, wherein the turbine engine is a gas turbine engine or a steam turbine engine.

14. The vane according to claim 2, wherein the load strut is arranged from a central area of the vane body to the outer platform.

15. The vane according to claim 1, wherein the load strut comprises a rectangular cross-section form.

* * * * *